US011805897B1

(12) United States Patent
Chen

(10) Patent No.: US 11,805,897 B1
(45) Date of Patent: Nov. 7, 2023

(54) COMBINED TYPE SHELF

(71) Applicant: Protrend Co., Ltd., Taipei (TW)

(72) Inventor: Shun-Yi Chen, Taipei (TW)

(73) Assignee: PROTREND CO., LTD., Taipei (TW)

( * ) Notice: Subject to any disclaimer, the term of this patent is extended or adjusted under 35 U.S.C. 154(b) by 0 days.

(21) Appl. No.: 18/094,414

(22) Filed: Jan. 9, 2023

(30) Foreign Application Priority Data

Oct. 3, 2022 (TW) ..... 111137451

(51) Int. Cl.
*A47B 57/12* (2006.01)
*A47B 96/06* (2006.01)
*A47B 55/02* (2006.01)
*A47B 87/00* (2006.01)

(52) U.S. Cl.
CPC ..... *A47B 57/12* (2013.01); *A47B 55/02* (2013.01); *A47B 87/001* (2013.01); *A47B 96/066* (2013.01); *A47B 96/068* (2013.01)

(58) Field of Classification Search
CPC ..... A47B 57/12; A47B 96/066; A47B 96/068; A47B 55/02; A47B 87/001
See application file for complete search history.

(56) References Cited

U.S. PATENT DOCUMENTS 2,894,643 A * 7/1959 Maslow ..... A47B 55/02 211/189
2,919,816 A * 1/1960 Maslow ..... A47B 55/02 403/217
2,970,702 A * 2/1961 Maslow ..... A47B 55/02 108/106
3,138,123 A * 6/1964 Maslow ..... A47F 5/13 108/159
3,146,735 A * 9/1964 Kesilman ..... A47F 5/13 108/181
3,208,408 A * 9/1965 Maslow ..... A47F 5/13 211/186
3,316,864 A * 5/1967 Maslow ..... A47B 57/54 211/186
4,735,325 A * 4/1988 Remmers ..... A47B 96/068 211/187
4,778,066 A * 10/1988 Stjernberg ..... A47B 57/12 211/186
4,934,858 A * 6/1990 Beaulieu ..... F16B 12/40 403/174

(Continued)

*Primary Examiner* — Stanton L Krycinski
(74) *Attorney, Agent, or Firm* — WPAT, P.C

(57) ABSTRACT

A combined type shelf includes double-rod frames, connecting assemblies, double-rod frames and storage-layer connector structures. The double-rod frame includes vertical post assemblies and horizontal rods, and the vertical post assembly includes a first straight upright rod and a second straight upright rod parallel to each other to provide a gap for receiving therebetween ends of the plurality of horizontal rods. The connecting assembly includes a main body, a back portion, a horizontal-rod engaging groove, a vertical-rod engaging groove and a first connecting-piece engaging cavity. The storage layer is disposed between the double-rod frames. The storage-layer connector structure, disposed to the storage layer, includes an inserting piece to be plugged into the first connecting-piece engaging cavity to connect each of the storage-layer connector structures to the connecting assembly to assemble the storage layer to the double-rod frame.

8 Claims, 13 Drawing Sheets

(56) References Cited

U.S. PATENT DOCUMENTS 5,027,959 A * 7/1991 Luukkonen ..... A47B 47/021 211/186
5,065,873 A * 11/1991 Tseng ..... A47B 57/54 211/186
5,221,014 A * 6/1993 Welch ..... A47F 5/13 211/187
5,833,084 A * 11/1998 Chang ..... A47B 55/02 211/90.03
6,119,881 A * 9/2000 Yang ..... A47B 55/02 211/189
6,364,138 B1 * 4/2002 Chen ..... A47B 57/26 211/187
6,431,090 B1 * 8/2002 Davis ..... A47B 57/04 108/107
6,971,528 B2 * 12/2005 Chen ..... A47B 57/40 211/187
7,543,540 B2 * 6/2009 Tatematsu ..... F16B 12/46 108/192
8,042,477 B2 * 10/2011 Lee ..... A47B 57/54 108/147.12
8,118,181 B2 * 2/2012 Shinozaki ..... A47B 47/0083 211/208
8,651,300 B2 * 2/2014 Chen ..... A47B 47/024 211/187
9,585,469 B2 * 3/2017 Huang ..... A47B 47/021
11,419,412 B1 * 8/2022 Chen ..... A47B 57/36
11,583,080 B2 * 2/2023 Chen ..... A47B 57/36
11,627,801 B2 * 4/2023 Chen ..... A47B 47/024 211/187
11,700,940 B1 * 7/2023 Chen ..... A47B 47/0083 211/187
2001/0006163 A1 * 7/2001 Scudeller ..... A46B 17/02 211/182
2007/0108147 A1 * 5/2007 Chen ..... A47B 47/00 211/187
2011/0220602 A1 * 9/2011 Chen ..... A47B 87/001 248/250
2012/0298606 A1 * 11/2012 Chen ..... A47B 57/265 211/186
2012/0298607 A1 * 11/2012 Chen ..... A47B 57/265 211/186
2021/0372448 A1 * 12/2021 Yang ..... F16B 12/44

* cited by examiner

COMBINED TYPE SHELF

CROSS REFERENCE TO RELATED APPLICATION

This application claims the benefits of Taiwan application Serial No. 111137451, filed on Oct. 3, 2022, the disclosures of which are incorporated by references herein in its entirety.

TECHNICAL FIELD

The present disclosure relates in general to a combined type shelf.

BACKGROUND

A combined type shelf is particularly assembled to meet different environmental requirements in an office, a domestic housing or any field the like. Taking a combined type shelf with double-rod frames as an example, four double-rod frames, two front and two rear, are provided to stand vertically, and at least two metal wires are disposed horizontally to upper and lower portions of the combined type shelf. The metal wire has oppositely two ends to be individually welded to the corresponding frames. In this shelf structure, at least one cross-shaped lead line structure is required to be mounted to the double-rod frames at the rear portion of the shelf, such that the storage layers can be mounted fixedly to the double-rod frames. However, all the aforesaid mounting requires specific tools, and thus both assembling and disassembling are difficult and time-consuming. In addition, such a shelf structure inhibits a possibility of horizontal extension. As a result, the use convenience would be significantly reduced.

Thus, how to improve the aforesaid shortcomings to the conventional shelf structure is definitely one of urgent issues in the art.

SUMMARY

An object of the present disclosure is to provide a combined type shelf that, without additional tool for assembling, can provide a simple and solid structure with less assembling difficulty but higher assembling flexibility.

In one aspect of this disclosure, a combined type shelf includes at least two double-rod frames, a plurality of connecting assemblies, at least two double-rod frames and a plurality of storage-layer connector structures. Each of the at least two double-rod frames includes two vertical post assemblies and a plurality of horizontal rods, and each of the two vertical post assemblies includes a first straight upright rod and a second straight upright rod parallel to each other to provide a gap for receiving therebetween ends of the plurality of horizontal rods. Each of the plurality of connecting assemblies includes a main body, a back portion, a horizontal-rod engaging groove, a vertical-rod engaging groove and a first connecting-piece engaging cavity. The horizontal-rod engaging groove is disposed at a front side of the main body, the back portion is connected with a rear side of the main body, the first connecting-piece engaging cavity is disposed between the back portion and the main body, the vertical-rod engaging groove is disposed inside the main body, the horizontal-rod engaging groove is to match the corresponding horizontal rod, and at least one of the first straight upright rod and the second straight upright rod is disposed in the vertical-rod engaging groove. The at least one storage layer is disposed between each of the at least two double-rod frames. Each of the plurality of storage-layer connector structures is disposed to the storage layer, each of the plurality of storage-layer connector structures includes an inserting piece to be plugged into the first connecting-piece engaging cavity to connect each of the plurality of storage-layer connector structures to the connecting assembly to assemble the storage layer to the double-rod frame.

In one embodiment of this disclosure, each of the plurality of connecting assemblies further includes a second connecting-piece engaging cavity disposed at the rear side of the main body and connected spatially with the first connecting-piece engaging cavity.

In one embodiment of this disclosure, each of the plurality of storage-layer connector structures includes an engaging piece to engage into the second connecting-piece engaging cavity.

In one embodiment of this disclosure, the engaging piece is a protrusion from a side of the inserting piece.

In one embodiment of this disclosure, each of the plurality of connecting assemblies further includes a guiding groove disposed inside the main body and connected spatially with the vertical-rod engaging groove.

In one embodiment of this disclosure, each of the plurality of connecting assemblies further includes a protrusive portion connected with one side of the main body, and the protrusive portion is disposed exterior to the first straight upright rod and the second straight upright rod.

In one embodiment of this disclosure, each of the plurality of connecting assemblies further includes an engaging portion connected with one side of the protrusive portion to be plugged between the first straight upright rod and the second straight upright rod.

In one embodiment of this disclosure, each of the plurality of connecting assemblies includes a first connecting assembly and a second connecting assembly, and the first connecting assembly and the second connecting assembly are engaged together.

As stated, the combined type shelves of this disclosure can be provided with simple and solid structures, and ease to assembling/disassembling. In addition, the storage-layer connector structures and the connecting assemblies can be integrated to provide a stable and compact combined type shelf, with no needs of the cross-shaped lead line structures, and a capacity of horizontal extension, such that the use convenience can be significantly improved.

In addition, in this disclosure, the connecting assembly is simply to mount one of the first straight upright rod and the second straight upright rod of the double-rod frame, then the assembly can be successful. Thus, the cost for manufacturing the connecting assembly can be effectively reduced.

Further scope of applicability of the present application will become more apparent from the detailed description given hereinafter. However, it should be understood that the detailed description and specific examples, while indicating exemplary embodiments of the disclosure, are given by way of illustration only, since various changes and modifications within the spirit and scope of the disclosure will become apparent to those skilled in the art from this detailed description.

BRIEF DESCRIPTION OF THE DRAWINGS

The present disclosure will become more fully understood from the detailed description given herein below and the accompanying drawings which are given by way of illustration only, and thus are not limitative of the present disclosure and wherein.

DETAILED DESCRIPTION

Figure 1:
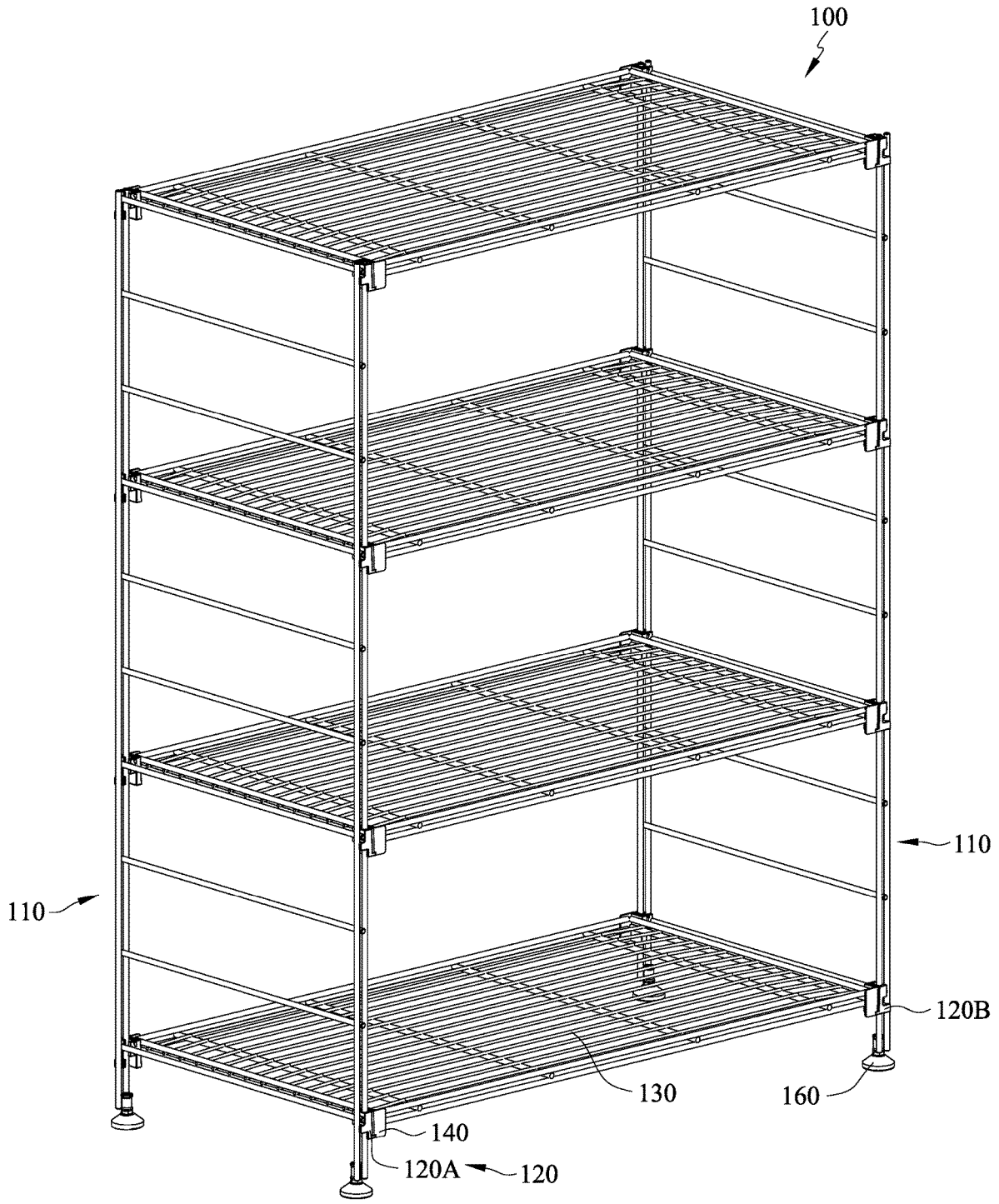
FIG. 1 is a schematic view of an embodiment of the combined type shelf in accordance with this disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

FIG. 1 is a schematic view of an embodiment of the combined type shelf in accordance with this disclosure. As shown, in this embodiment, the combined type shelf 100 includes at least two double-rod frames 110 (four double-rod frames 110 in FIG. 1), a plurality of connecting assemblies 120, a plurality of storage layers 130 and a plurality of storage-layer connector structures 140. With different combinations of the aforesaid elements, various combined type shelves can be formed. Each of the connecting assemblies 120 includes a first connecting assembly 120A and a second connecting assembly 120B.

For example, with the storage-layer connector structures 140 to engage the corresponding connecting assemblies 120, the storage layer 130 can be mounted between two of the double-rod frames 110 (left and right) to form the combined type shelf 100 having one shelving unit and at least one storage layer. In other words, without any tool for assembling, various combinations of the combined type shelf 100 of this disclosure can be formed by particular pairing of the double-rod frames 110, the storage-layer connector structures 140 and the connecting assemblies 120.

Thereupon, the combined type shelves 100 can be provided with simple and solid structures, and ease to assembling/disassembling. In addition, the storage-layer connector structures 140 and the connecting assemblies 120 can be integrated to provide a stable and compact combined type shelf 100, with no needs of the cross-shaped lead line structures, and a capacity of horizontal extension (FIG. 11), such that the use convenience can be significantly improved. In some other embodiments, foot stands 160 can be provided to stand the double-rod frame 110, such that the stability of the entire combined type shelf 100 can be ensured.

Figure 2:
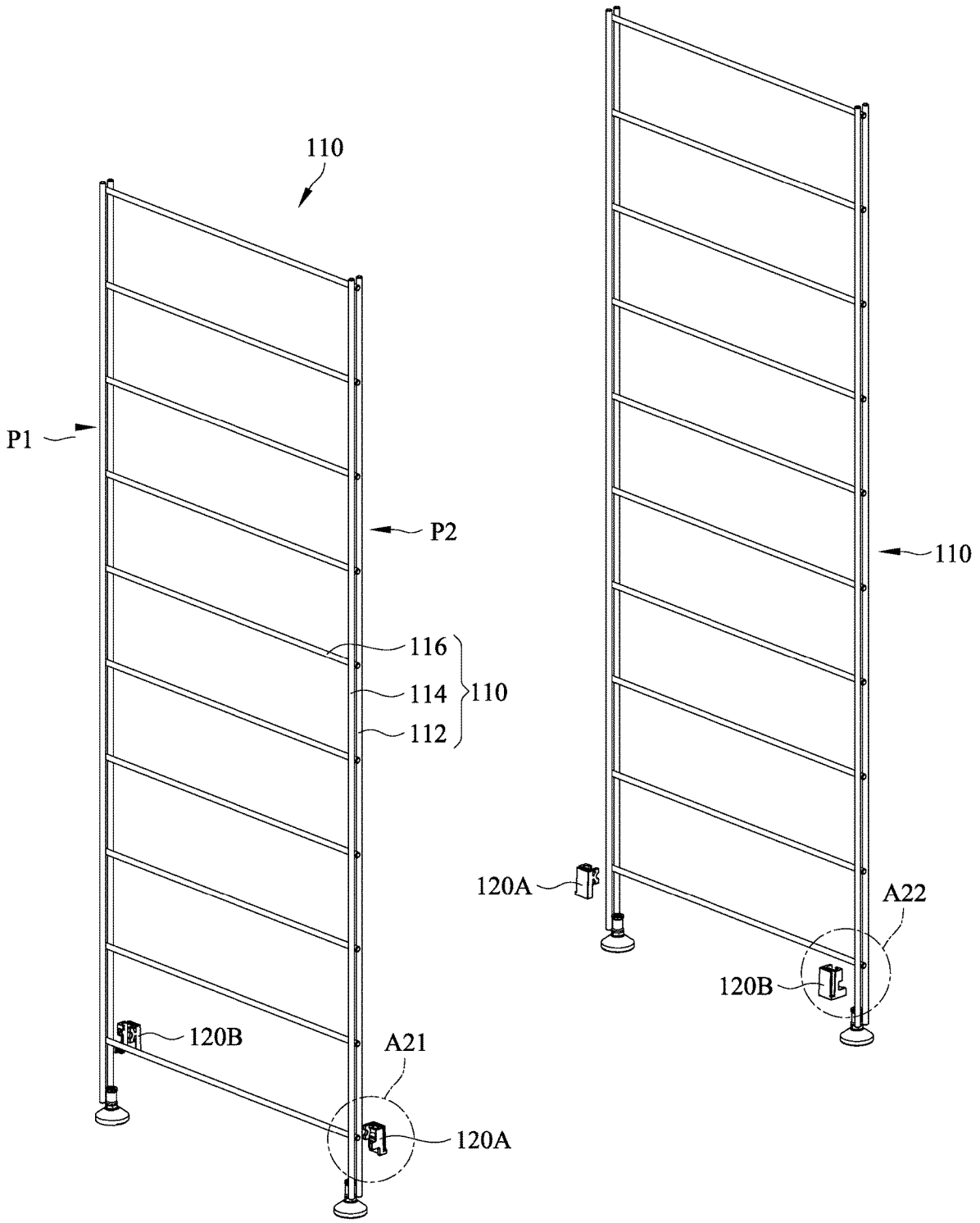
FIG. 2 is a schematic view of the double-rod frame of FIG. 1.
Figure 3A:
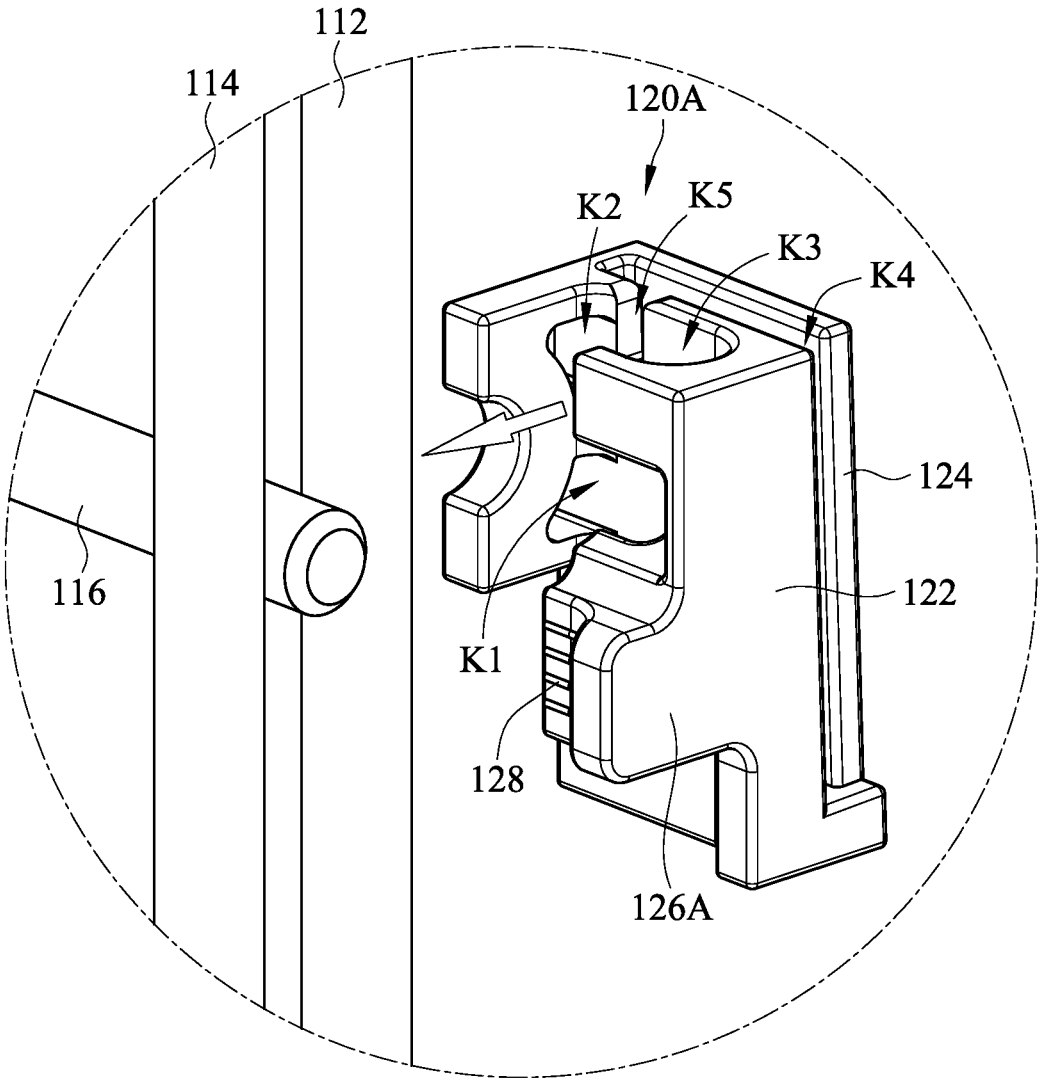
FIG. 3A is a schematic enlarged view of area A21 of FIG. 2.
Figure 3B:
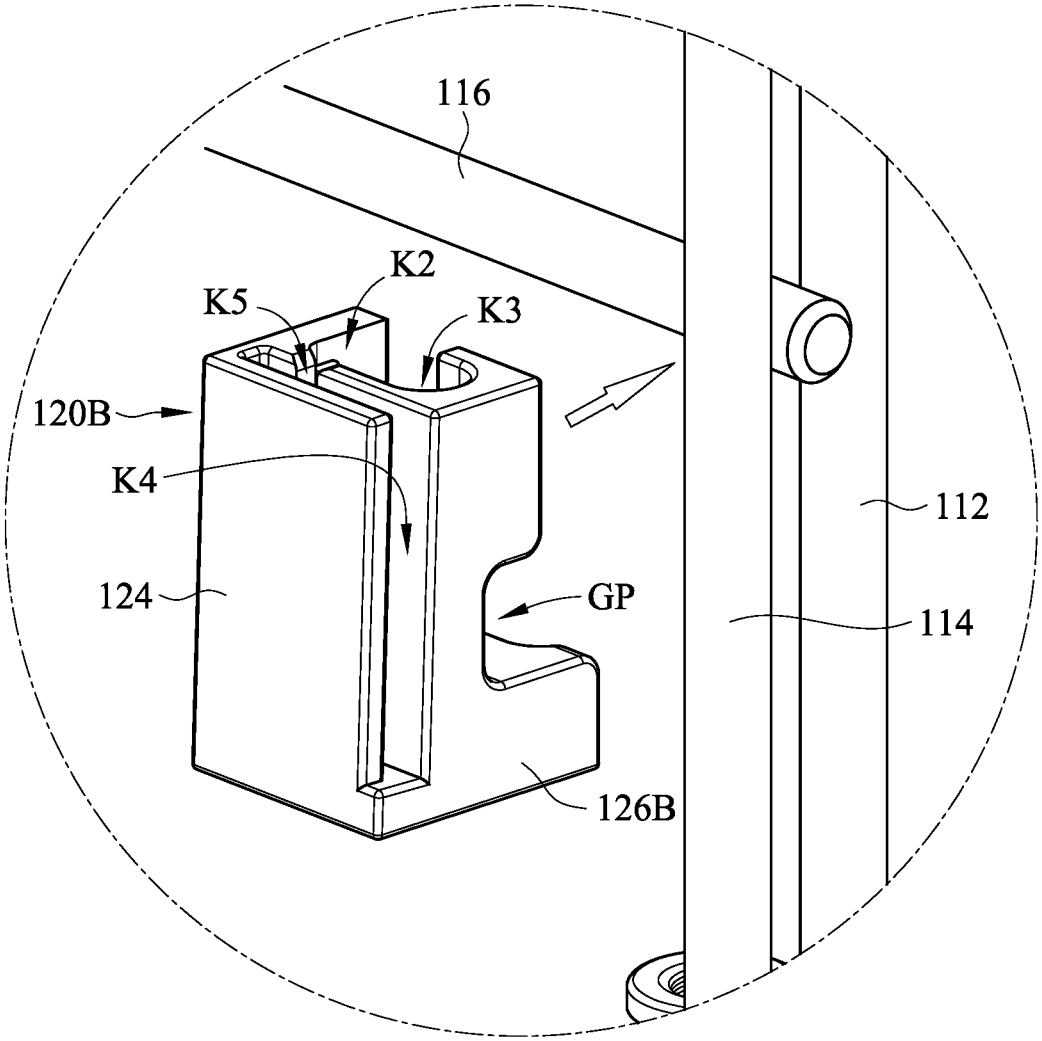
FIG. 3B is a schematic enlarged view of area A22 of FIG. 2.

FIG. 2 is a schematic view of the double-rod frame of FIG. 1, FIG. 3A is a schematic enlarged view of area A21 of FIG. 2, and FIG. 3B is a schematic enlarged view of area A22 of FIG. 2. Referring to FIG. 1 to FIG. 3B, in this embodiment, each of the double-rod frames 110 includes two vertical post assemblies P1, P2 and a plurality of horizontal rods 116. These horizontal rods 116 are disposed horizontally between the two vertical post assemblies P1, P2, by parallel to each other. Each of the vertical post assemblies P1, P2 includes a first straight upright rod 112 and a second straight upright rod 114 parallel to the first straight upright rod 112. Two opposite ends of the horizontal rod 116 are individually fixed between the first straight upright rod 112 and the second straight upright rod 114. In particular, the first straight upright rod 112 and the second straight upright rod 114 are just separated by a gap for allowing ends of the horizontal rod 116 to penetrate through.

In this embodiment, the connecting assembly 120 includes a first connecting assembly 120A and a second connecting assembly 120B. In the double-rod frame 110 located at the left hand side, a front end of the double-rod frame 110 is the first connecting assembly 120A, while a rear end thereof is the second connecting assembly 120B. On the other hand, in the double-rod frame 110 located at the right hand side, a front end of the double-rod frame 110 is the second connecting assembly 120B, while a rear end thereof is the first connecting assembly 120A. Namely, a front side of the combined type shelf 100 (as shown in FIG. 1) includes the first connecting assembly 120A and the second connecting assembly 120B, while a rear side thereof includes the second connecting assembly 120B and the second connecting assembly 120A. Here, the first connecting assembly 120A and the second connecting assembly 120B are formed as a pair.

In this embodiment, each of the connecting assemblies 120 (the first connecting assembly 120A of FIG. 3A and the second connecting assembly 120B of FIG. 3B) includes a main body 122, a back portion 124, a horizontal-rod engaging groove K1, a guiding groove K2, a vertical-rod engaging groove K3, a first connecting-piece engaging cavity K4 and a second connecting-piece engaging cavity K5. The horizontal-rod engaging groove K1 is formed at a front side of the main body 122, the back portion 124 is connected with a rear side of the main body 122, and the first connecting-piece engaging cavity K4 is disposed between the back portion 124 and the main body 122. As such, the first connecting-piece engaging cavity K4 provides an accommodation space between the main body 122 and the back portion 124. The second connecting-piece engaging cavity K5 is disposed at the rear side of the main body 122, and the second connecting-piece engaging cavity K5 connects spatially the first connecting-piece engaging cavity K4. In particular, the second connecting-piece engaging cavity K5 can be formed by a lateral opening of the main body 122.

The guiding groove K2 and the vertical-rod engaging groove K3 are individually formed inside the main body 122, and the guiding groove K2 is connected spatially with the vertical-rod engaging groove K3. A longitudinal extension direction of the guiding groove K2 or the vertical-rod engaging groove K3 is different to that of the horizontal-rod engaging groove K1. In one embodiment, the longitudinal extension direction of the guiding groove K2 or the vertical-rod engaging groove K3 is perpendicular to that of the horizontal-rod engaging groove K1. The guiding groove K2 is an opening of the main body 122 to connect spatially a portion of the horizontal-rod engaging groove K1, while the vertical-rod engaging groove K3 is extended outward to connect spatially another portion of the horizontal-rod engaging groove K1.

Each of the connecting assemblies 120 further includes a protrusive portion. The protrusive portion (the first connecting assembly 120A of FIG. 3A and the second connecting assembly 120B of FIG. 3B) is extended in a direction different to a direction that the horizontal-rod engaging groove K1 extends. The difference between the first connecting assembly 120A of FIG. 3A and the second connecting assembly 120B of FIG. 3B is at the disposition of the protrusive portion. The first connecting assembly 120A includes a first protrusive portion 126A connected with one side of the main body 122. The second connecting assembly 120B includes a second protrusive portion 126B also connected with a side of the corresponding main body 122. However, the formation of the first protrusive portion 126A and that of the second protrusive portion 126B are different. The first protrusive portion 126A is protruded from a middle portion of the side of the main body 122, while the second protrusive portion 126B is protruded from a lower portion of the side of the main body 122. The second connecting assembly 120B includes a receiving recess GP to correspond the first protrusive portion 126A. Thereupon, the first protrusive portion 126A can engage the receiving recess GP to connect the first connecting assembly 120A and the second connecting assembly 120B.

Each of the connecting assemblies 120 further includes an engaging portion 128 connected with a side of the protrusive portion (including the first protrusive portion 126A of FIG. 3A and the second protrusive portion 126B of FIG. 3B). The engaging portion 128 is protruded from a surface of the protrusive portion (including the first protrusive portion 126A of FIG. 3A and the second protrusive portion 126B of FIG. 3B), and an extension direction of the engaging portion 128 is the same as the extension direction of the horizontal-rod engaging groove K1.

Figure 4A:
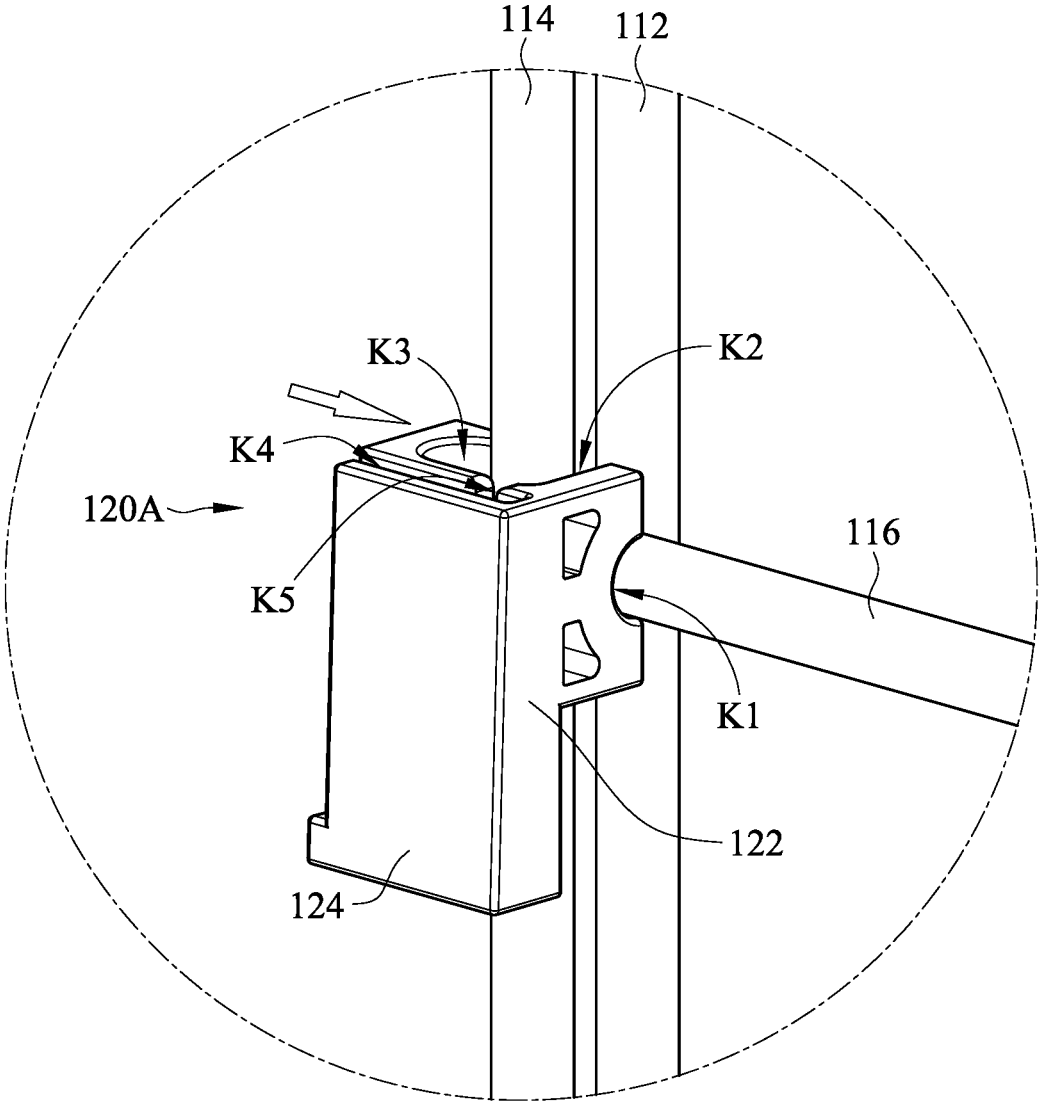
FIG. 4A is schematic view of a state that the connecting assembly is assembled to the double-rod frame in accordance with this disclosure.
Figure 4B:
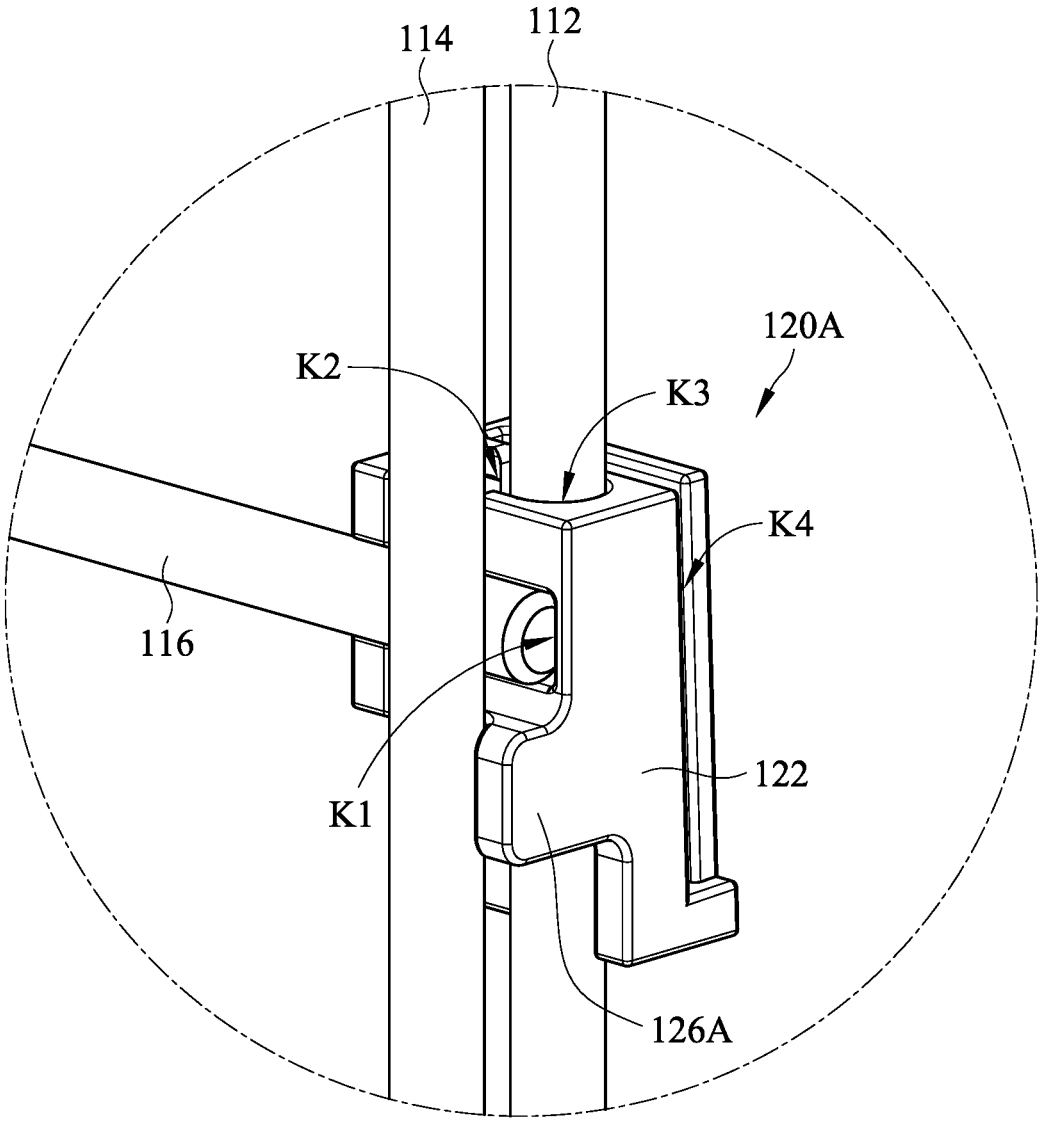
FIG. 4B is another view of FIG. 4A.

As shown in FIG. 3A and FIG. 3B, each of the connecting assemblies 120 is to move toward the double-rod frame 110, with the horizontal-rod engaging groove K1 to match the horizontal rod 116. Then, as shown in FIG. 4A, the horizontal-rod engaging groove K1 of the connecting assembly 120 can engage the horizontal rod 116, and at this time the second straight upright rod 114 of the double-rod frame 110 is located in the guiding groove K2. Namely, each of the connecting assemblies 120 an be assembled to the double-rod frame 110 by having the guiding groove K2 of the connecting assembly 120 to receive the second straight upright rod 114 (or the first straight upright rod 112) of the double-rod frame 110, and the horizontal-rod engaging groove K1 to engage the horizontal rod 116. Then, as shown in FIG. 4B, the connecting assembly 120 can move further to have the horizontal rod 116 to slide along the horizontal-rod engaging groove K1 of the connecting assembly 120, and thus the second straight upright rod 114 (or the first straight upright rod 112) of the double-rod frame 110 can be shifted from the guiding groove K2 into the vertical-rod engaging groove K3. At the same time, one end of the horizontal rod 116 would contact an inner wall of the horizontal-rod engaging groove K1, and the engaging portion 128 would be plugged between the first straight upright rod 112 and the second straight upright rod 114. All the aforesaid protrusive portions (including the first protrusive portion 126A of FIG. 3A and the second protrusive portion 126B of FIG. 3B) are disposed exterior to the first straight upright rod 112 and the second straight upright rod 114. With the horizontal-rod engaging groove K1, the vertical-rod engaging groove K3 and the engaging portion 128 to pair the horizontal rod 116, the first and second straight upright rods 112, 114, and also the first and second straight upright rods 112, 114, respectively, a stable and solid structuring relationship can be established by having the connecting assembly 120 to engage the first straight upright rod 112 and the second straight upright rod 114. Namely, in this embodiment, by assembling the connecting assembly 120 to the first straight upright rod 112 or the second straight upright rod 114, a flexible assembly can be provided.

It shall be explained that, as shown in FIG. 1 and FIG. 4B, the connecting assembly 120 needs to pair one of the first straight upright rod 112 and the second straight upright rod 114 of the double-rod frame 110, then the aforesaid assembly advantage can be obtained, and thus cost for manufacturing the connecting assembly 120 can be effectively reduced.

Figure 5:
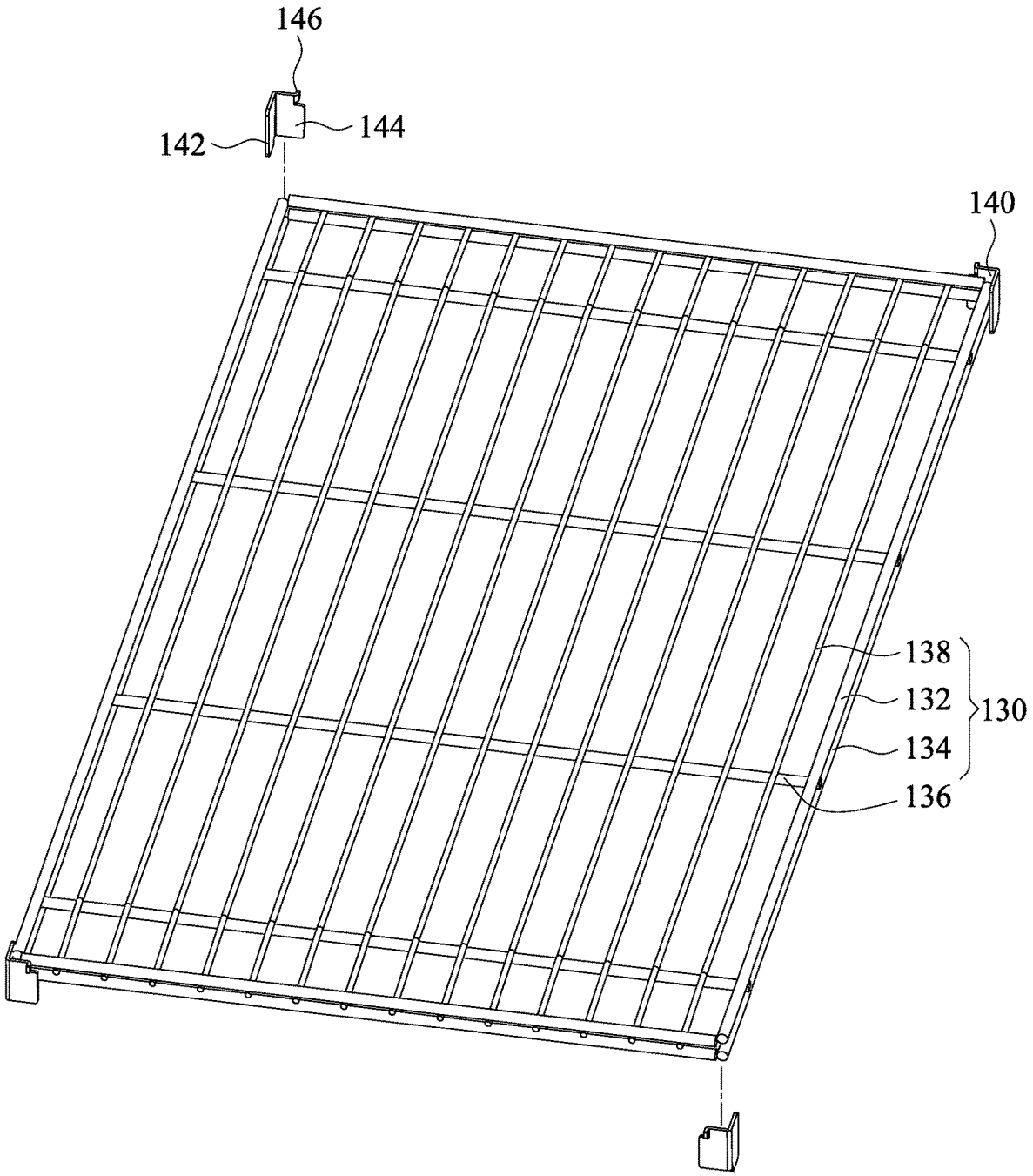
FIG. 5 is a schematic view of the storage layer and the storage-layer connector structures of FIG. 1.

FIG. 5 is a schematic view of the storage layer and the storage-layer connector structures of FIG. 1. As shown, in one embodiment, the storage layer 130 includes a plurality of first side bars 132, a plurality of second side bars 134, a plurality of first inner bars 136 and a plurality of second inner bars 138. The first inner bars 136 are separately arranged in parallel to each other in a direction, while the second inner bars 138 are separately arranged in parallel to each other in another direction, such that a frame work for the storage layer 130 can be provided. The first side bars 132 and the second side bars 134 are disposed to surround the frame work of the first inner bars 136 and the second inner bars 138 so as to form the rims thereof. In particular, the first side bar 132 and the corresponding second side bar 134 are spaced by a gap for receiving ends of the first inner bars 136 and the second inner bars 138.

In this embodiment, the storage-layer connector structure 140 includes a fastener piece 142, an inserting piece 144 and an engaging piece 146. The fastener piece 142 is a plate, the inserting piece 144 is connected angular with a side of the fastener piece 142. As shown in FIG. 5, the inserting piece 144 and the fastener piece 142 is angular connected, and this angle can be adjusted according to the design of the storage layer 130. In one embodiment, the inserting piece 144 is roughly a plate, the engaging piece 146 is angular connected to one side of the inserting piece 144, and the engaging piece 146 is extended in a direction different to the extension direction of the fastener piece 142. The engaging piece 146 can be formed as a protrusion from a side of the inserting piece 144.

In one embodiment, the storage-layer connector structure 140 is applied to a corner of the storage layer 130, the fastener piece 142 can be welded or fixed appropriately to the storage layer 130, and the inserting piece 144 would keep a distance to the storage layer 130.

Figure 6:
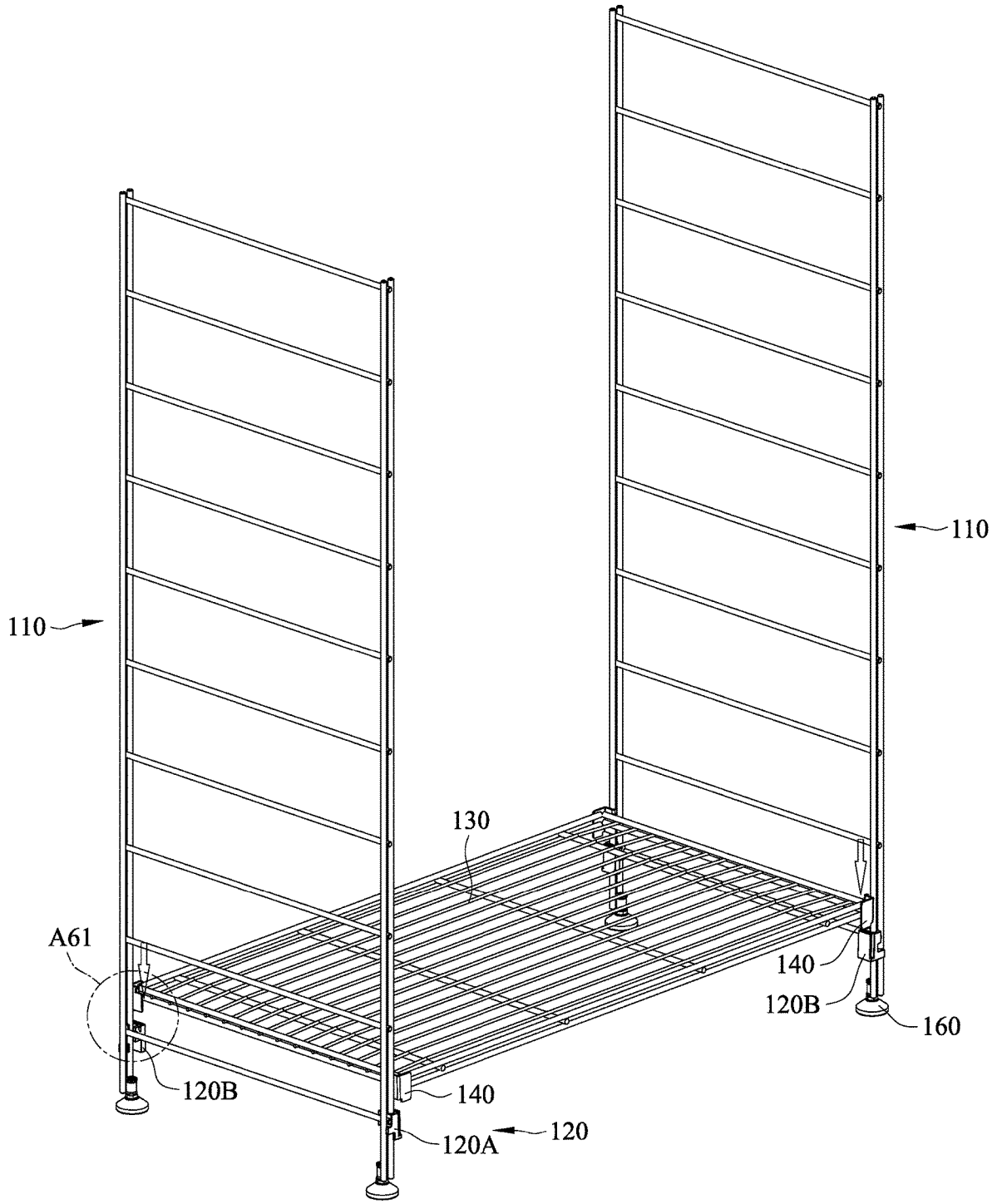
FIG. 6 is a schematic view of a stage of assembling the storage layer to the double-rod frame of FIG. 1.
Figure 7:
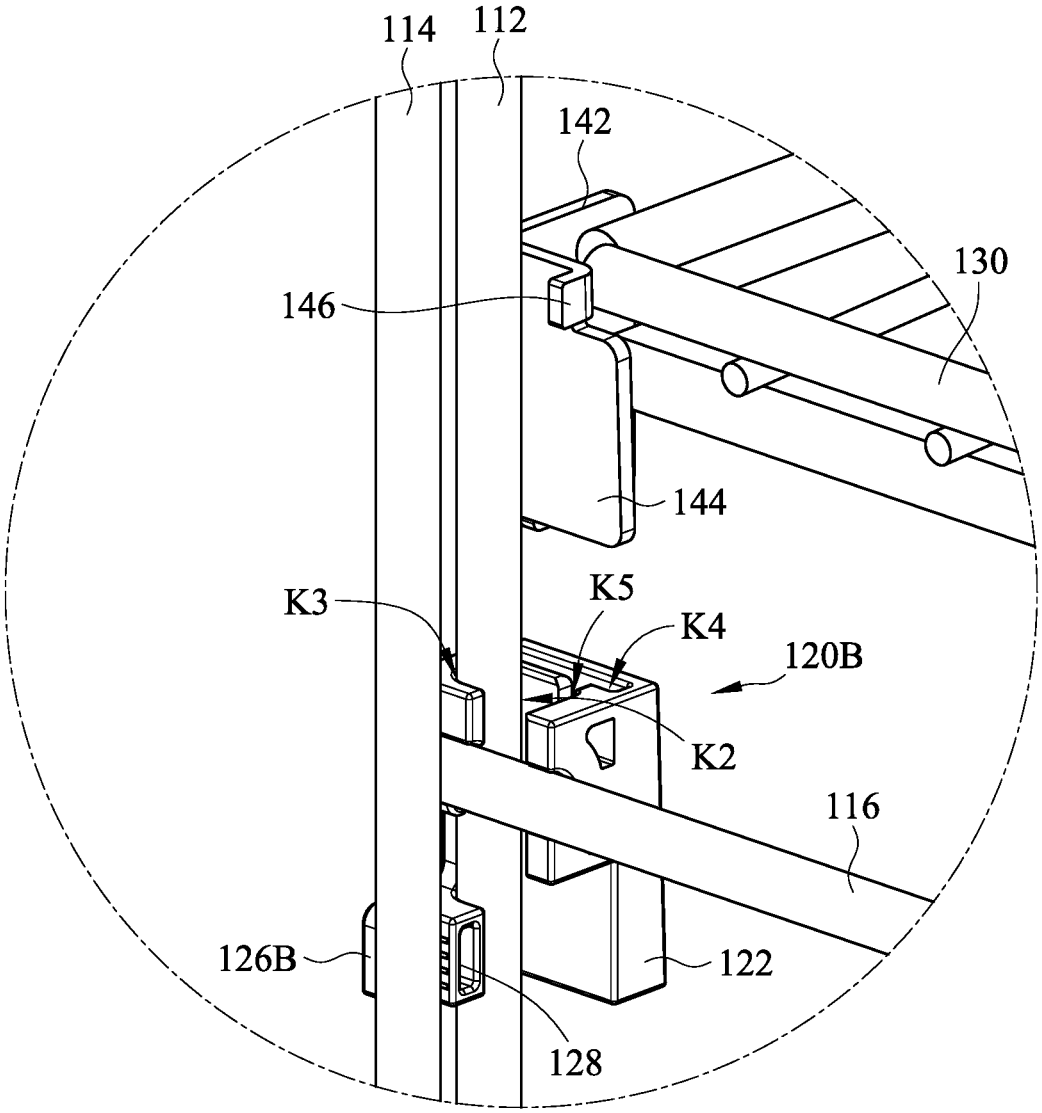
FIG. 7 is a schematic enlarged view of area A61 of FIG. 6.
Figure 8:
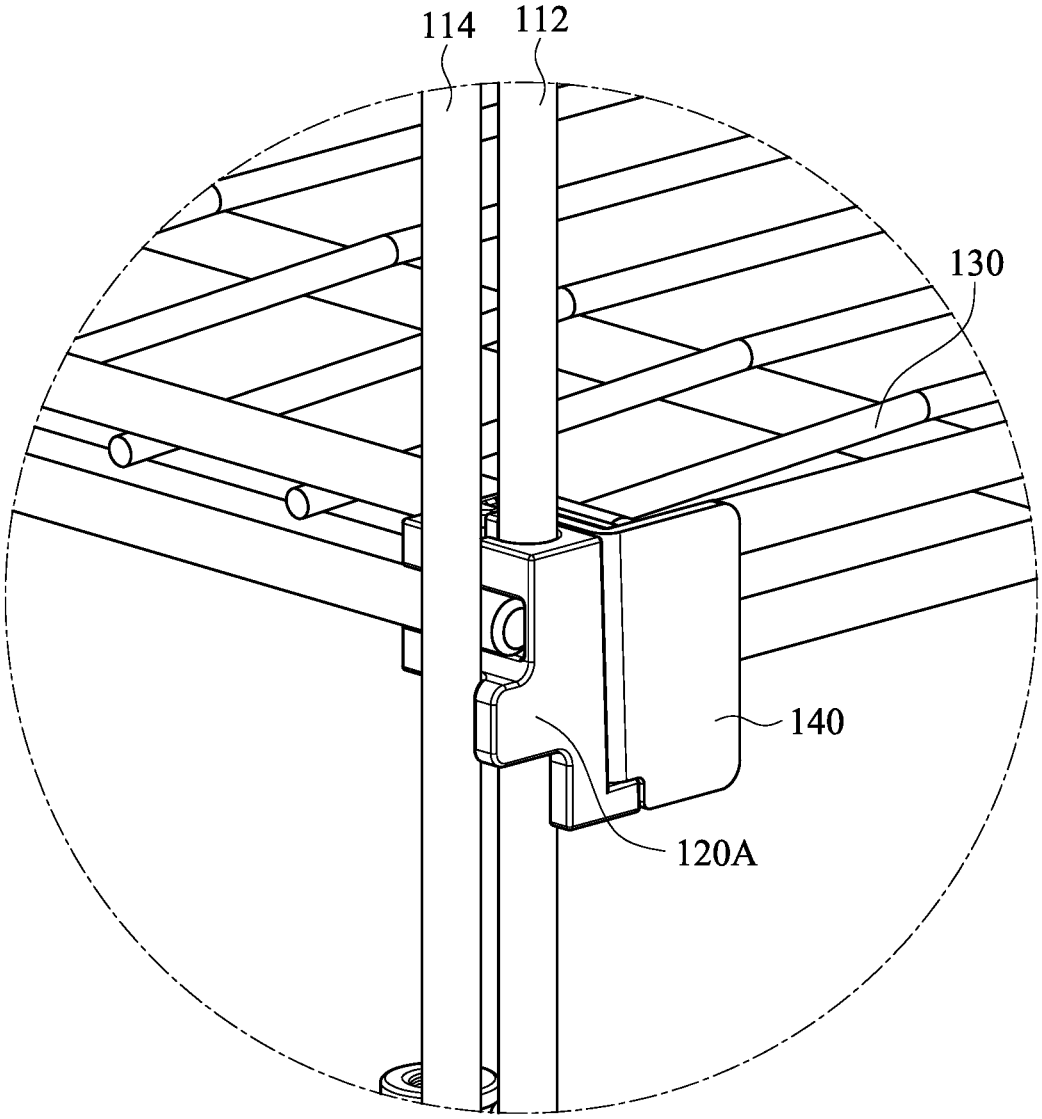
FIG. 8 is a schematic enlarged view showing the storage-layer connector structure is assembled to the connecting assembly of FIG. 1.

FIG. 6 is a schematic view of a stage of assembling the storage layer to the double-rod frame of FIG. 1, FIG. 7 is a schematic enlarged view of area A61 of FIG. 6, and FIG. 8 is a schematic enlarged view showing the storage-layer connector structure is assembled to the connecting assembly of FIG. 1. Referring to FIG. 6 to FIG. 8, a storage layer 130 is to be assembled between the double-rod frames 110. As shown in FIG. 6 and FIG. 7, the storage layer 130 is firstly to face downward along the double-rod frame 110, such that the inserting piece 144 of the storage-layer connector structure 140 can correspond to the first connecting-piece engaging cavity K4 of the connecting assembly 120, and the engaging piece 146 of the storage-layer connector structure 140 can correspond the second connecting-piece engaging cavity K5. Thereupon, the inserting piece 144 can be plugged into the first connecting-piece engaging cavity K4, and the engaging piece 146 can engage into the second connecting-piece engaging cavity K5. With the inserting piece 144 and the engaging piece 146 to provide two different assembling directions, then the storage-layer connector structure 140 can stably assemble the connecting assembly 120, and can assembly the storage layer 130 between the double-rod frames 110.

Figure 9:
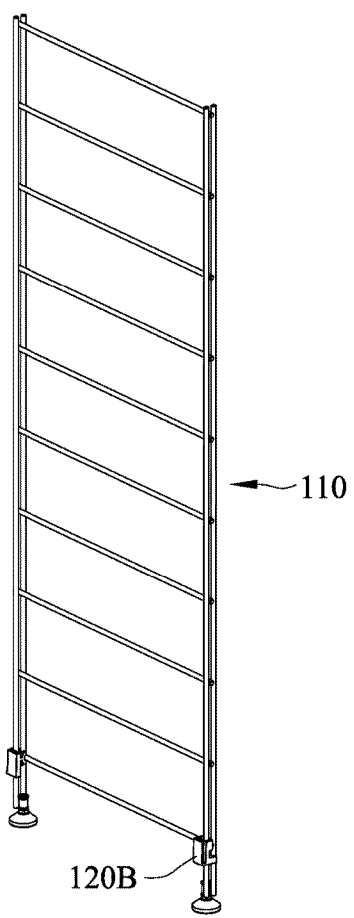
FIG. 9 is a schematic view of another embodiment of the combined type shelf in an assembling state in accordance with this disclosure.
Figure 9:
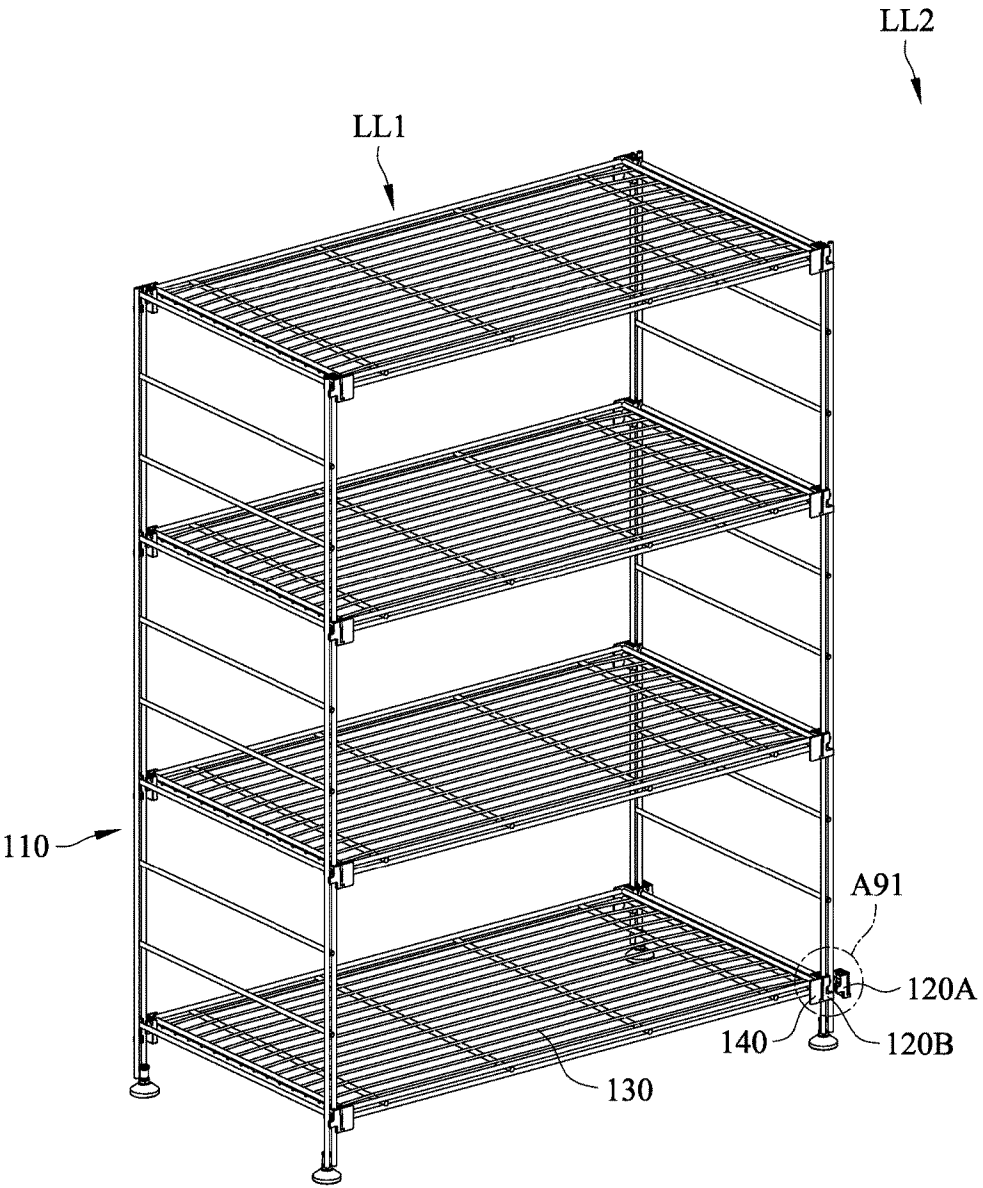
Figure 10:
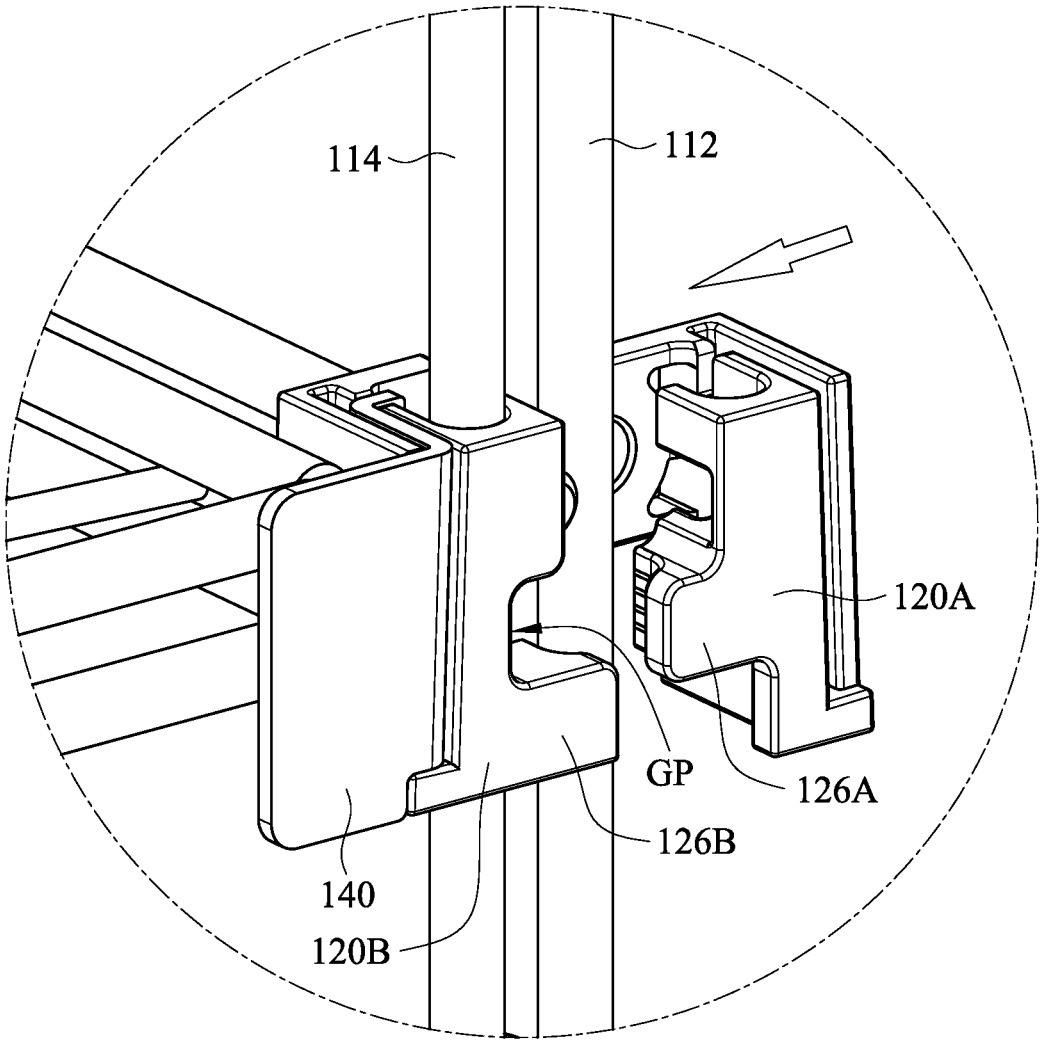
FIG. 10 is a schematic enlarged view of area A91 of FIG. 9.
Figure 11:
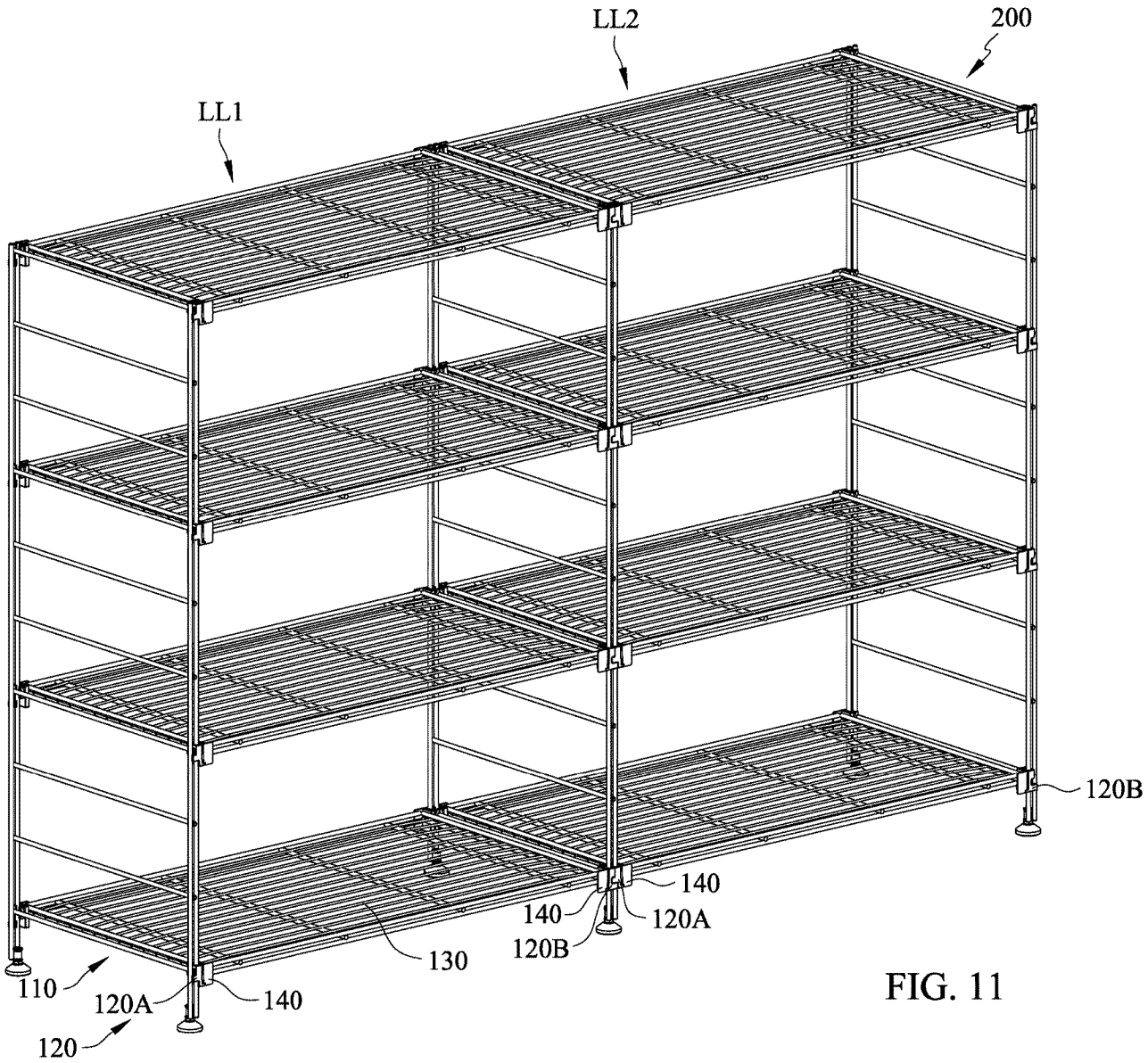
FIG. 11 is a schematic view of a further embodiment of the combined type shelf in accordance with this disclosure.

FIG. 9 is a schematic view of another embodiment of the combined type shelf in an assembling state in accordance with this disclosure, FIG. 10 is a schematic enlarged view of area A91 of FIG. 9, and FIG. 11 is a schematic view of a further embodiment of the combined type shelf in accordance with this disclosure. As shown in FIG. 9 and FIG. 10, the combined type shelf having a first shelving unit LL1 (similar to the combined type shelf 100 of FIG. 1), while the connecting assembly 120 (including the first connecting assembly 120A and the second connecting assembly 120B) is simply installed to one of the first straight upright rod 112 and the second straight upright rod 114 of the double-rod frame 110, then the combined type shelf having the first shelving unit LL1 can be obtained. As shown in FIG. 10, the second straight upright rod 114 of the double-rod frame 110 at a right front end of the first shelving unit LL1 is furnished with the second connecting assembly 120B, and the first straight upright rod 112 is yet to install the connecting assembly. At this time, in a horizontal extension to add a second shelving unit LL2 aside the first shelving unit LL1, then the second connecting assembly 120B can be provided to the first straight upright rod 112. The installation can be referred to the aforesaid description about the assembly of the second connecting assembly 120B and the double-rod frame 110. With the first connecting assembly 120A to match the second connecting assembly 120B, then the first protrusive portion 126A can engage the receiving recess GP so as to combine together the first connecting assembly 120A and the second connecting assembly 120B. As shown in FIG. 11, the combined type shelf 200 can then have the first shelving unit LL1 and the second shelving unit LL2 connected horizontally.

To sum up, in this disclosure, the combined type shelves can be provided with simple and solid structures, and ease to assembling/disassembling. In addition, the storage-layer connector structures and the connecting assemblies can be integrated to provide a stable and compact combined type shelf, with no needs of the cross-shaped lead line structures, and a capacity of horizontal extension, such that the use convenience can be significantly improved.

In addition, in this disclosure, the connecting assembly is simply to mount one of the first straight upright rod and the second straight upright rod of the double-rod frame, then the assembly can be successful. Thus, the cost for manufacturing the connecting assembly can be effectively reduced.

With respect to the above description then, it is to be realized that the optimum dimensional relationships for the parts of the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present disclosure.

What is claimed is:

1. A combined type shelf, comprising:

at least two double-rod frames, each of the at least two double-rod frames including two vertical post assemblies and a plurality of horizontal rods, each of the two vertical post assemblies including a first straight upright rod and a second straight upright rod parallel to each other to provide a gap for receiving therebetween ends of the plurality of horizontal rods;

a plurality of connecting assemblies, each of the plurality of connecting assemblies including a main body, a back portion, a horizontal-rod engaging groove, a vertical-rod engaging groove and a first connecting-piece engaging cavity, the horizontal-rod engaging groove being disposed at a front side of the main body, the back portion being connected with a rear side of the main body, the first connecting-piece engaging cavity being disposed between the back portion and the main body, the vertical-rod engaging groove main body, the horizontal-rod engaging groove correspondingly matching a respectively one of the horizontal rods, at least one of the first straight upright rod and the second straight upright rod of one of the two vertical post assemblies being disposed in the vertical-rod engaging groove;

at least one storage layer, disposed between each of the at least two double-rod frames; and a plurality of storage-layer connector structures, each of the plurality of storage-layer connector structures being disposed to the storage layer, each of the plurality of storage-layer connector structures including an inserting piece to be plugged into the first connecting-piece engaging cavity of one of the connecting assemblies to connect each of the plurality of storage-layer connector structures to the connecting assembly to assemble the storage layer to the double-rod frame.

2. The combined type shelf of claim 1, wherein each of the plurality of connecting assemblies further includes a second connecting-piece engaging cavity disposed at the rear side of the main body and connected spatially with the first connecting-piece engaging cavity.

3. The combined type shelf of claim 2, wherein each of the plurality of storage-layer connector structures includes an engaging piece to engage into the second connecting-piece engaging cavity of the respective connecting assembly.

4. The combined type shelf of claim 3, wherein the engaging piece is a protrusion from a side of the inserting piece.

5. The combined type shelf of claim 1, wherein each of the plurality of connecting assemblies further includes a guiding groove disposed inside the main body and connected spatially with the vertical-rod engaging groove.

6. The combined type shelf of claim 1, wherein each of the plurality of connecting assemblies further includes a protrusive portion connected with one side of the main body, and the protrusive portion is disposed exterior to the respective first straight upright rod and the respective second straight upright rod.

7. The combined type shelf of claim 6, wherein each of the plurality of connecting assemblies further includes an engaging portion connected with one side of the protrusive portion to be plugged between the respective first straight upright rod and the respective second straight upright rod.

8. The combined type shelf of claim 1, wherein each of the plurality of connecting assemblies includes a first connecting assembly and a second connecting assembly, and the first connecting assembly and the second connecting assembly are engaged together.

* * * * *